United States Patent [19]

Papp

[11] Patent Number: 4,502,688

[45] Date of Patent: Mar. 5, 1985

[54] WRIST AND HAND SUPPORT DEVICE

[76] Inventor: Robert G. Papp, 121 Clapboard Rd., Danbury, Conn. 06810

[21] Appl. No.: 476,498

[22] Filed: Mar. 18, 1983

Related U.S. Application Data

[63] Continuation-in-part of Ser. No. 337,700, Jan. 7, 1982, abandoned.

[51] Int. Cl.[3] ..... A63B 69/36

[52] U.S. Cl. ..... 273/189 A; 2/161 A

[58] Field of Search ..... 273/189 R, 189 A, 54 B; 2/161 A

[56] References Cited

U.S. PATENT DOCUMENTS

| | | | |
|---|---|---|---|
| 1,469,315 | 10/1923 | Hansard | 273/189 A |
| 3,423,095 | 1/1969 | Cox | 273/189 A |
| 3,606,342 | 9/1971 | Albertson | 273/189 R |
| 3,700,245 | 10/1972 | Nannini | 273/189 A |
| 3,704,994 | 12/1972 | Krzewinski | 273/54 B |
| 3,779,550 | 12/1973 | Benoun et al. | 2/161 A X |
| 4,057,255 | 11/1977 | Bishop | 273/189 R |
| 4,138,108 | 2/1979 | Robinson | 273/189 A |
| 4,190,906 | 3/1980 | Patton | 2/161 A |

*Primary Examiner*—George J. Marlo
*Attorney, Agent, or Firm*—Joseph R. Carvalko, Jr.

[57] ABSTRACT

A wrist and hand support device to be worn on a user's hand in combination with a glove for supporting and strengthening the user's arm and hand movements to thereby minimize hyperflexion and hyperextension and generally assist the user to increase proper control of a golf club during a golf swing, is disclosed. The device includes in combination a wristband that is disposed about a wrist joint over the glove about the area of the transverse carpal ligament, the radius and the ulna bone structure and the brachioradialis muscle at the muscle position over the radius bone at the wrist to provide support and thereby strengthen the ligamentis structure and musculature and provide support for bone structure; a releasable fastener for adjustably securing the wristband about the wrist joint whereby the wristband provides the support; a flexible support member projecting from the wristband and having sufficient stiffness for placement, specific positioning and providing support against a part of the back portion of the user's hand during use of the device, the support member projecting in a position extending from over the area of the brachioradialis muscle at the muscles position over the radius bone at the wrist, over the transverse carpal ligament and along and over the second metacarpal, terminating prior to the first knuckle of the index finger; and a releasable fastener for securing the flexible support member to the glove over the area of the second metacaparal.

1 Claim, 11 Drawing Figures

WRIST AND HAND SUPPORT DEVICE

RELATED APPLICATIONS

This application is a continuation-in-part of application Ser. No. 337,700, filed Jan. 7, 1982, for Wrist and Hand Support Device, now abandoned.

BACKGROUND OF THE DISCLOSURE

1. Field of the Invention

This invention relates to a support device of the type that is commonly worn by persons involved in an athletic activity, and more particularly to a wrist and hand support device to be worn on a user's wrist and hand in combination with a glove for supporting and thereby strengthening the user's arm and hand movements to thereby minimize hyperflexion and hyperextension and generally assist the user in obtaining increased proper control of a golf club when the user is in the process of attempting to swing a golf club correctly.

2. Description of the Prior Art

The prior art describes numerous types of devices that are used for the purpose of physically assisting people participating in athletic activities such as golf, tennis, bowling, etc. Many of these devices are typically worn on a portion of the user's arm and/or hand, both with and without a glove, for the primary purpose of bracing or preventing movement of a particular portion of the user's muscle or bone anatomy. For, example, (i) U.S. Pat. No. 3,779,550 describes a wrist brace for use in bowling to restrict the movement of the user's wrist joint; (ii) U.S. Pat. No. 4,057,255 describes a golf swing aid that comprises a glove which assists the golfer in hitting the golf ball squarely; and (iii) U.S. Pat. No. 4,190,906 discloses a bowler's glove and wrist support which combines certain structural features to provide a stable relationship between the forearm, wrist and hand the user. Other examples of these types of devices that are known in the art are illustrated and described in U.S. Pat. Nos. 2,709,257, 4,040,632, 4,138,108, 274,616, 3,815,908, 3,588,917, 4,051,552, 4,197,592, 3,423,095, 3,408,077, 2,924,458, 1,226,160, 3,790,168, 3,490,768, 3,512,776, 3,261,026, 3,229,306, 3,228,035, 1,469,315, 3,700,245, 3,274,616, 1,418,637, 3,606,342, 4,070,027, 4,047,250, 4,176,840, 3,871,029, and 4,088,318. While most of the devices described in the prior art for bracing a portion of the user's arm and/or hand so as to assist the user in a particular athletic activity, generally provide some of the desirable features required for this type of device, these known devices do present many problems. For example, many of the known devices do not provide the amount or degree of support that is required for a particular athletic activity, and/or also allow too much freedom of action. These bracing devices do not provide the support with resulting strengthening of certain portions of the user's anatomy as provided by the present invention. Several of the devices actually unnecessarily restrict movement of a particular portion of the user's anatomy during an activity. Furthermore, many of the devices shown in the prior art are cumbersome, difficult to use, very complicated in their design features and expensive and difficult to manufacture.

SUMMARY OF THE INVENTION

It is therefore an object of the present invention to provide a wrist and hand support device to be worn on a user's wrist and hand in combination with a glove to provide support to certain portions of the user's anatomy and thereby create, retain and continuously maintain strength in said anatomy by the supportive features of the device. It is a further object of the present invention to provide a wrist and hand support device to be worn on a user's wrist and hand in combination with a glove to provide correct support without allowing excessive freedom of action, which device thus strengthens the user's arm and hand movements thereby helping to minimize hyperflexion and hyperextension and to assist the user to increase his/her proper control of the golf club when attempting to swing a golf club.

It is a further object of the present invention to provide a wrist and hand support device to be worn by a golfer which tends to restrict only those arm and hand movements during a golf swing that would be considered disadvantageous while encouraging a golfer to use more of the body's muscles systems in harmonic synchronization as required by a correct golf swing, thereby allowing the user to substantially improve his/her golf swing without interfering with all of the golfer's required movements of a correct golf swing.

It is a further object of the present invention to provide a wrist and hand support device to be worn by a golfer that is easy to use (including easy to put on and take off) and easy to adjust It is a further object of the present invention to provide a wrist and hand support device to be worn by a golfer that is simple in its design features, and relatively inexpensive and simple to manufacture.

It is still a further object of the present invention to provide a wrist and hand support device to be worn by a golfer which in combination supports the wrist, substantially strengthens muscles in the user hand and forearm, increases golf club control (from driver to putter), increases the users shoulder turn and swing arc, properly positions the golf club at the top portion of the swing, improves the user's swing tempo, increases the user's clubhead speed, produces stronger, squarer hand at impact of the ball with the club, extends physical stamina of the golfer, improves ball contact, trajectory and accuracy, developes user muscle memory and builds player confidence.

The foregoing objects and others are accomplished in accordance with the present invention by providing a wrist and hand support device to be worn on a user's wrist and hand in combination with a glove for supporting and strengthening the user's arm and hand movements to thereby minimize hyperflexion and hyperextension and generally assist the user to increase proper control of a golf club during a golf swing. The device includes in combination a wristband that is disposed about a wrist joint over the glove about the area of the transverse carpal ligament, the radius and the ulna bone structure and the brachioradials muscle at the muscle position over the radius bone at the wrist to provide support and thereby strengthen the ligament is structure and musculature and provide support for bone structure; a releasable fastener for adjustably securing the wristband about the wrist joint whereby the wristband provides the support; a flexible support member projecting from the wristband and having sufficient stiffness for placement, specific positioning and providing support against a part of the back portion of the user's hand during use of the device, the support member projecting in a position extending from over the area of the brachioradialis muscle at the muscles position over the radius bone at the wrist, over the transverse carpal ligament and along and over the second metacarpal, terminating prior to the first knuckle of the index finger; and a releasable fastener for securing the flexible support member to the glove over the area of the second metacarpal.

BRIEF DESCRIPTION OF THE DRAWINGS

For a better understanding of the invention as well as other objects and further features thereof, reference is made to the following detailed disclosure of this invention taken in conjunction with the accompanying drawings wherein.

DESCRIPTION OF THE PREFERRED EMBODIMENTS

Figure 1:
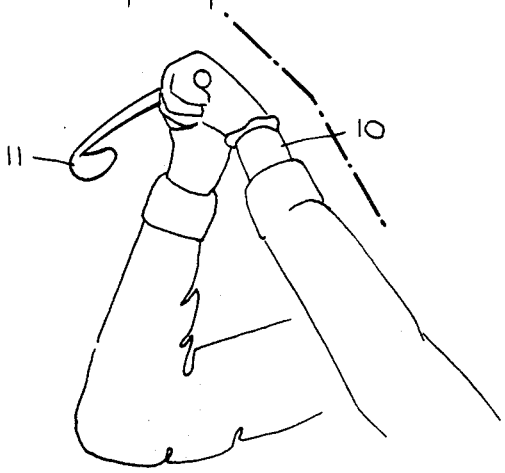
FIG. 1 is a partial perspective view of golfer's hands during a golf swing illustrating the problem of hyperflexion.
Figure 2:
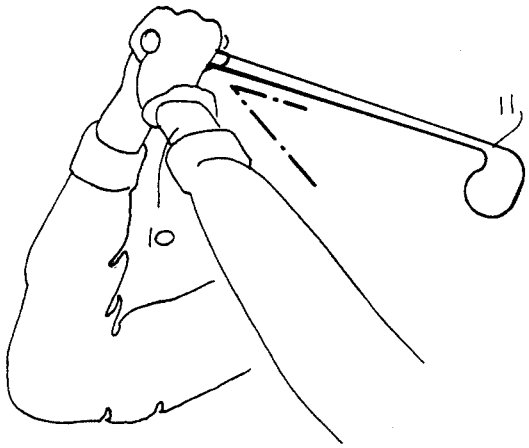
FIG. 2 is a partial perspective view of golfer's hands during a golf swing illustrating the problem of hyperextension.
Figure 3:
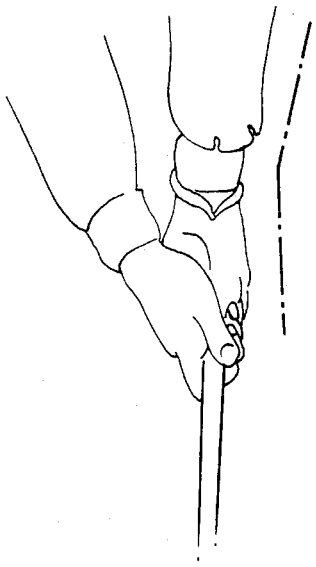
FIG. 3 is a first partial perspective view of golfer's hands illustrating the proper arm-hand relationship during a golf swing.
Figure 4:
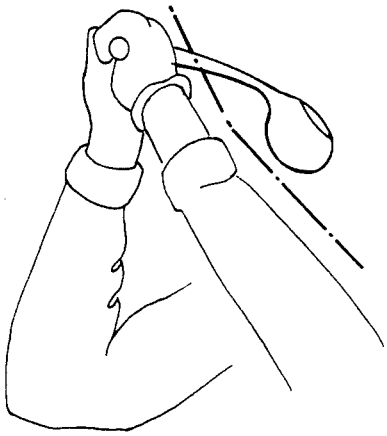
FIG. 4 is a second partial perspective view of golfer's hands illustrating proper arm-hand relationship during a golf swing.

As is well known, there are correct and incorrect ways for the arms and hands of a golfer to be positioned during a golf swing. The correct positioning of the arms and hands and proper movement thereof during a golf swing are, of course, necessary for the golfer's clubhead to make solid contact with the golf ball. This arm-hand relationship is directly related to the movement (flexing or cocking) of the golfer's wrist. Improper flexing of the golfer's wrist shows itself in the form of two basic golf swing positioning problems, i.e. hyperflexion and hyperextension. As is illustrated in FIG. 1, when the golfer's left wrist 10 is bowed outward at the top, the golf club 11 will be laid off (hyperflexion). As illustrated in FIG. 2, if the left wrist 10 is cupped inward too much, the golf club 11 will be in a position where the clubhead is pointing across the intended line at the top (hyperextension). The correct positioning of the golfer's arms and hands is illustrated in FIGS. 3 and 4 where, as shown, the relationship of the left forearm and back of the left hand at the point of addressing the golf ball (FIG. 3) should be maintained at the top of the swing (FIG. 4) if the golf club is to be set in the proper position for the clubhead to make solid contact with the golf ball. It is with the use of the wrist and hand support device in accordance with the present invention that (i) the golfer's arm movements will be supported, and thus subtantially strengthened, (ii) the continued supportive features of the device in accordance with the present invention will continually strengthen the users wrist hand and arm, (iii) the problems of hyperflexion and hyperextension will be minimized thereby resulting in correct arm-hand relationship, and (iv) an assistance will be provided to the user such that he/she will obtain increased proper control of the golf club when attempting to swing the club correctly.

Figures 5, 7, 8:
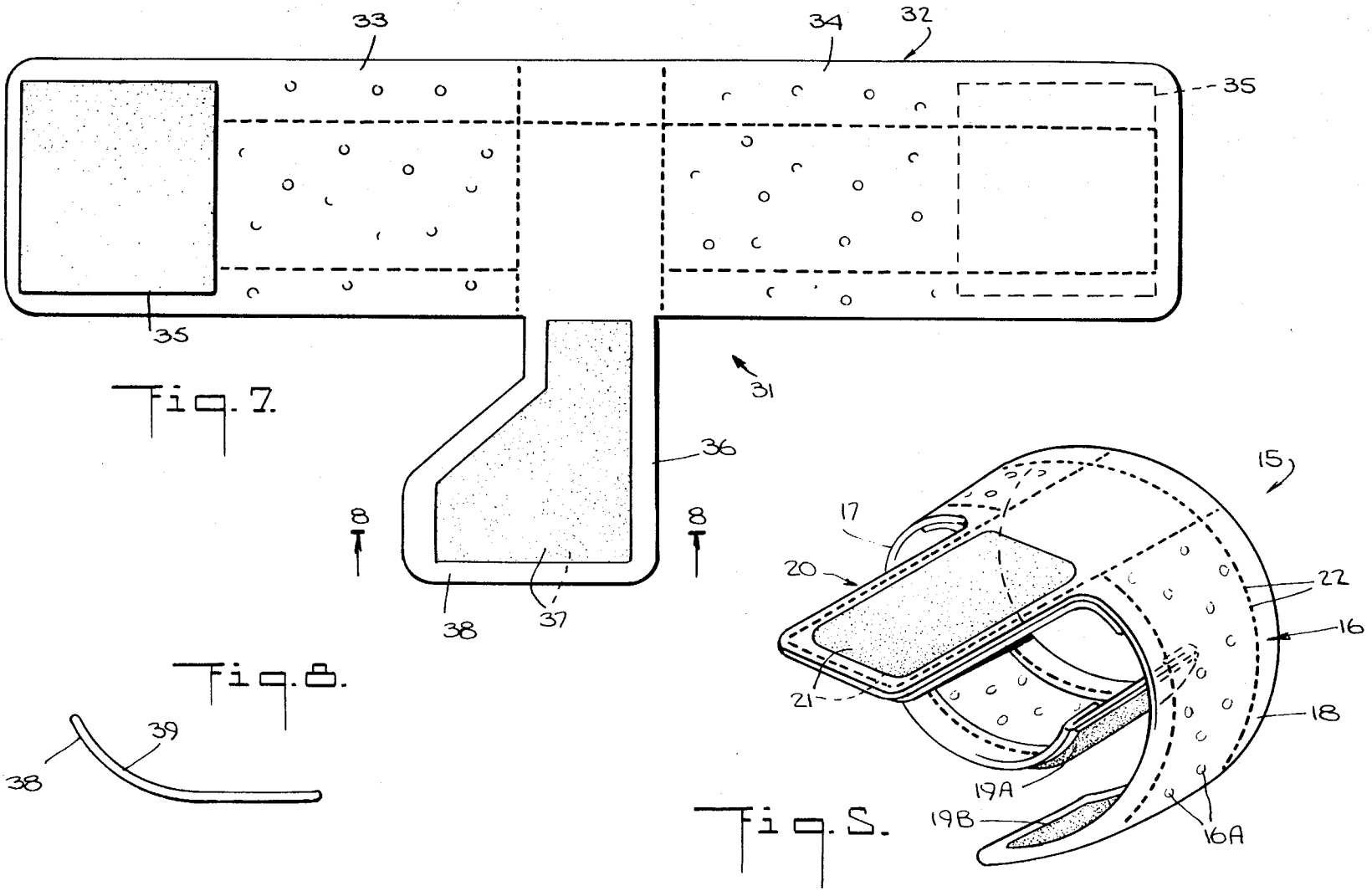
FIG. 5 is a perspective view of a wrist and hand support device in accordance with the present invention.
FIG. 7 is a plan view of another embodiment of a wrist and hand support device in accordance with the present invention.
FIG. 8 is a cross sectional plan view taken along the line 8—8 of FIG. 7.

Referring now to FIG. 5 there is shown an embodiment of a wrist and hand support device 15 in accordance with the features of the present invention comprising a removable and adjustable wristband 16 that includes two free end strap portions 17 and 18 to which a releasable fastening means 19 A and 19 B is attached in a manner for allowing the strap portions to be adjustably secured about the user's wrist so that the wristband can be firmly secured over the area of the transverse carpal ligament to provide support therefor specifically in the manner as described hereinbelow. When secured together the strap portions are in an overlapped position. The wrist and hand device includes a flexible support member 20 encased as a part and extending substantially perpendicular from wristband 16, and releasable fastening means 21 preferably secured to the end portion of the member on both the top and bottom (not shown) surface thereof for securing the extended portion of the support member to a glove in a manner as described hereinbelow. Also illustrated in the embodiment shown in FIG. 5 is stitching 22 which holds together the various materials of which the device is made.

Figure 10:
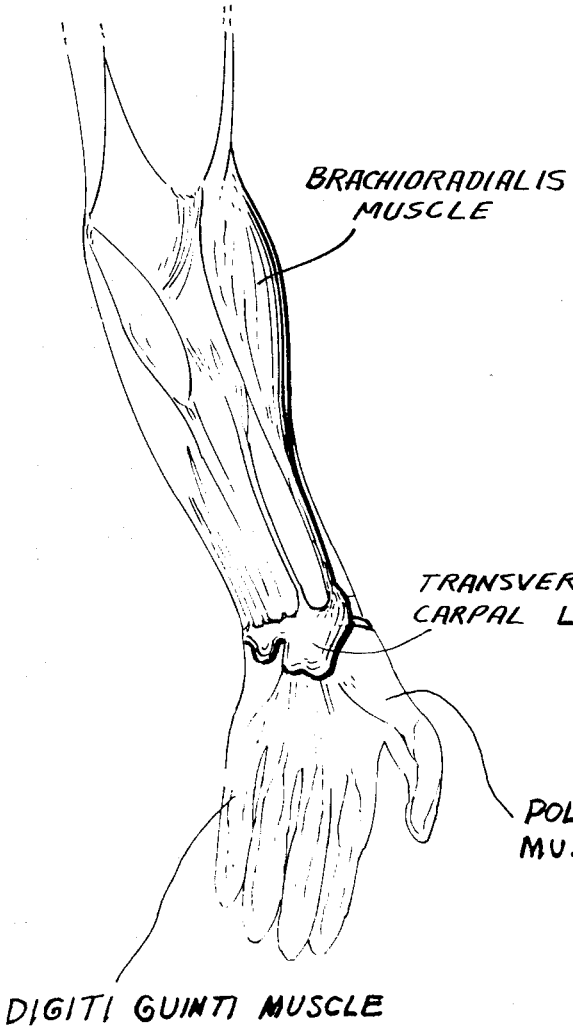
FIG. 10 is a plan view of the anatomy of a portion of a human's arm illustrating muscle and ligament tissue.
Figure 11:
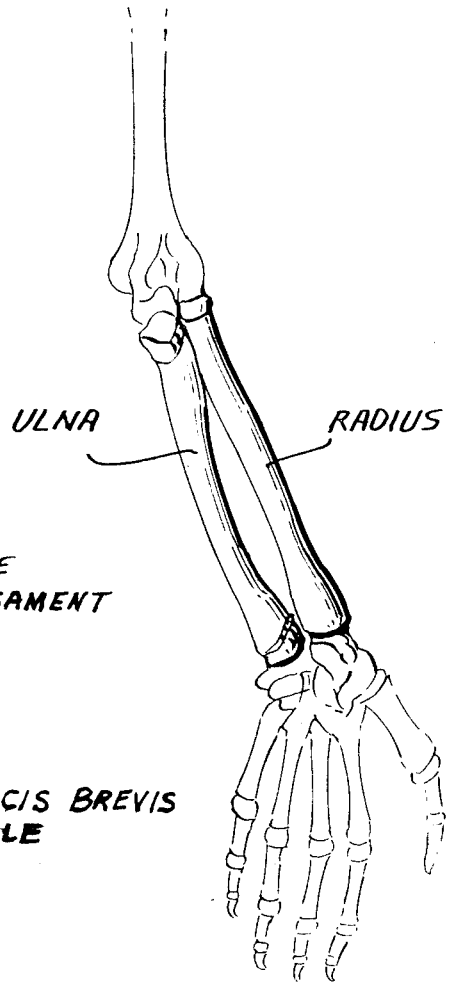
FIG. 11 is a plan view of the anatomy of a portion of a human's arm illustrating bones.

Wristband 16 in accordance with the present invention, firmly secured around the users wrist joint, supports and stabilizes the position of bone structure, namely the radius and the ulna (see FIG. 11), supports and strengthens ligamentis structure particularly the transverse carpal ligament and musculature, particularly the brachioradialis muscle (see FIG. 10) at the muscles position over the radius bone at the users wrist. In doing so an isotonic reaction in reflex against resistance, which is the result of the even and combined pressure applied by wristband 16 and flexible support member 20 secured to a golf glove, creates a substantial strengthening effect to the users muscles in the forearm and hand. It is the increased muscle strength and the support provided to the user's forearm and hand that allows the user to better execute the proper swing principles when swinging a golf club. It is the increased muscle strength and support that increases the user's control of the golf club during the golf swing without total restriction of movement during the swing that enables the user to better execute proper swing principles. The support member 20 combined with the wristband maintains muscle strength by preventing the breakdown of the golf swing. Breaking the wrist without proper support, causes the radius and the ulna to separate, and what is meaningful about this is that the transverse ligament has imbedded underneath it the neurological bed that feeds the digiti quinti muscle (in the little finger) and the pollicis longus muscle (in the thumb). The separation of the radius and the ulna causes a weakening effect, namely a weakening in the ability to approximate the little finger to the thumb which causes another common golf swing fault referred to as "loseing the club at the top".

Used as a teaching and training aid, the present invention is capable of developing muscle memory in muscles throughout the body, as these muscles synchronize harmoniously to produce a correct golf swing, guided by the support member 20. It is the correct golf swing accomplished as a result of the foregoing factors that produces lower golf scores by the user. The muscle memory developed as a result of using the present invention can be maintained with sporadic use of the invention, to retain the muscle memory developed.

Wrist and hand support device 15 can be manufactured of various types of materials. It is, however, preferred in accordance with the present invention that the device be fabricated of a flexible and relatively soft material such as a leather type of fabric, e.g. leather, naugahide or vinyl. It is also preferred that the relatively soft material include perforations 16 A and the device include a cloth or padding material coextensive with and secured to the bottom portion of the device, i.e. the portion of the device in contact with the user.

Figure 9:
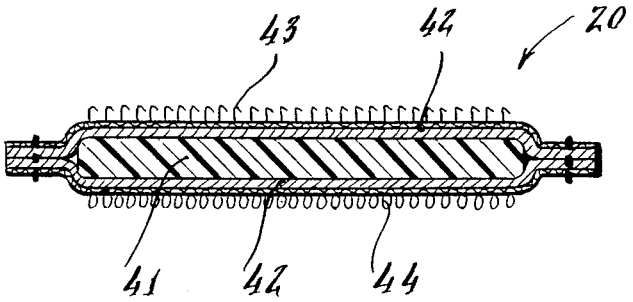
FIG. 9 is a plan view of a cross section of the flexible support member in accordance with the present invention.

Support member 20 preferably comprises a flexible strip of material encased within the leather type of fabric that wrist and hand support device 15 is manufactured from (see FIG. 9). The term "flexible" as used in the present specification and the claims to describe the support member means a member that (a) has sufficient resiliency to allow the member to bend to an applied force (stress) and then return to its original configuration when the force is removed (relieved), (b) has sufficient rigidity (stiffness) to allow the support member to remain positioned against a portion of the back of the users hand during use, and (c) which has sufficient rigidity that it can apply a sufficient degree of resistance to a back portion of the user's hand above the second metacarpal to (i) minimize the total flexing of the user's wrist, and (ii) cause muscle flexion in the hand and forearm of the user. It is important to note, that should the support member move around or be moved, for example, to the middle of the back portion of the hand, the device in accordance with the present invention will not function. I have found that various types of plastic materials are particularly suitable for this purpose such as polycarbonate and plexiglass.

In accordance with the present invention any suitable separable fastening means can be employed that enables the user to easily remove and adjust strap portions 17 and 18 about the user's wrist. As illustrated in FIG. 5, one such preferred fastener is a separable fastener sold under the trademark "Velcro" comprising a patch of loop pile fabric 19 A that can be secured to the top part of strap portion 17, and a patch of hook type fabric 19 B that can be secured to the bottom part of strap portion 18. The same type of Velcro separable fastener can be used for releasably securing the extended portion of support member 20 to the user's glove in the manner as described hereinbelow.

Figure 6:
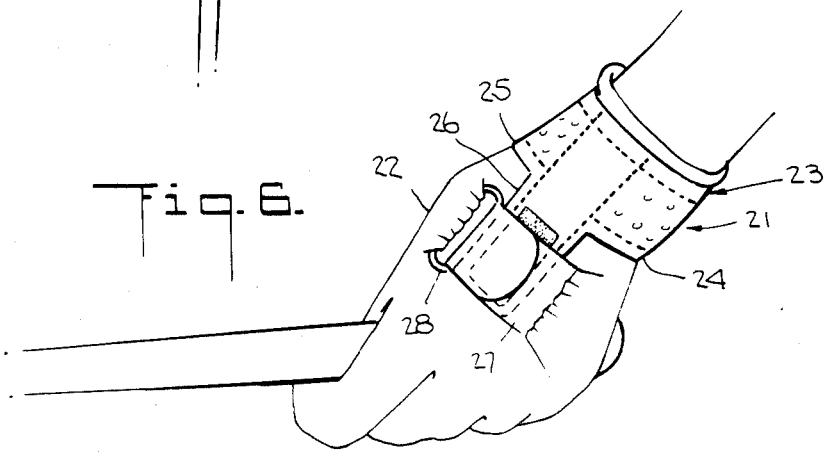
FIG. 6 is a partial perspective view of a wrist and hand support device in accordance with the present invention positioned on a golfer's hand along with a glove.

There is illustrated in FIG. 6 a wrist and hand support device 21 in combination with a glove 22 in accordance with the present invention both positioned on a user's hand in a manner which will tend to support, and thus strengthen user's arm movements and which will tend to minimize the problems of hyperflexion and hyperextension when swinging a golf club. As illustrated, wristband 23, comprising strap portions 24 and 25, is securely disposed about the user's wrist joint. The wristband is positioned about the user's wrist to approximate the radius and ulna at the wrist and supports the transverse carpal ligament and associated muscle structures, including tendons, in the user's hand and forearm. In accordance with a critical feature of the present invention flexible support member 26, extends from wristband 23 in a substantially perpendicular manner, and is fastened to glove 22 along a part of the back portion of the user's hand such that the support member extends from the area of the brachioradialis muscle at this muscles position over the radius bone at the wrist, over the transverse carpal ligament, and along and over the area of the second metacarpal and terminates prior to the first knuckle of the index finger. In use, flexible support member 26 transfers passive motion of extension of the second metacarpal at its proximal end, to stabilization from a neutral position, into active resistance, establishing an isometric muscular recoil reflex condition in which the length of individual muscles does not change, but rather individual fibers in muscles tighten without shortening. Glove 22, as illustrated in the drawings and as employed within the present invention, is conventional, and comprises a readily available commercial glove. Although there is illustrated in the drawings a left hand glove worn by a right handed golfer, it is to be understood that the present invention is equally applicable to a right hand glove worn by a left handed golfer.

As further illustrated in FIG. 6, glove 22 includes a flap member 27 which is pulled over flexible support member 26 and releasably fastened to the top surface 28 thereof. Fastening the flexible support member in this manner, in addition to fastening the bottom surface of the support member to lie in against the back portion of the user's hand, provides an additional means for securing the support member on the user's hand in the proper position. It is preferred in accordance with the present invention that the fastening means used on the top surface of the support member comprise a patch of Velcro hook type elements for being releasably interengaged with loop type elements found on flap member 27. The opposite and bottom surface of the support member can include a patch of Velcro loop type elements for being reasonably interengaged with hook type elements secured to glove 22 whereby the support member can be secured against the back portion of the user's hand over the area of the second metacarpal.

Another embodiment of a wrist and hand support device in accordance with the present invention is illustrated in FIGS. 7 and 8. As shown, device 31 comprises a removable and adjustable wristband 32 that includes two free end strap portions 33 and 34 to which a releasable fastening means 35 is attached in a manner for allowing the strap portions to be adjustably secured about the user's wrist over the area of the transverse carpal ligament to provide support thereof. When secured together the strap portions are in an overlapped position. Device 31 includes a flexible support member 36 extending substantially perpendicular from wristband 32 and releasable fastening means 37 preferably secured to the end portion of the member on both the top and bottom surface thereof for securing the extended portion of the support member to a glove in the manner as described hereinabove. Support member 36 includes a protruding portion 38 extending from the end part of the support member toward the direction of the user's thumb. Protruding portion 38 has an arcuately shaped cross section (FIG. 8) such that it can conform to the contour of the back portion of the user's hand.

Surface 39 of the protruding portion lies against the hand.

As illustrated in FIG. 9, support member 20 preferably includes a layered configuration comprising a flexible strip of material 41, such as plastic, that is encased within a leather type of fabric 42. When using the preferred Velcro loop type elements 44, such as plastic, that is encased within a leather type of fabric 42. When using the preferred Velcro type separable fastening means, Velcro hook type elements 43 preferably would be located on the top portion of support member 20.

While this invention has been described in conjunction with specific embodiments thereof, it is evident that many alternatives, modification and variations will be apparent to those skilled in the art. Accordingly, the present invention is intended to embrace all such alternatives, modifications and variations and fall within the spirit of the appended claims.

I claim:

1. A wrist and hand support device to be worn on a user's wrist and hand for supporting the user's arm and hand movements, and a glove to be worn on the user's hand and attached to said wrist and hand support device, said wrist and hand support device and said glove comprising in combination;

A. a wristband for being disposed about a wrist joint about the area of the transverse carpal ligament, the radius and the ulna bone structure and the brachioradialis muscle at the muscle position over the radius at said bone structure at said wrist, and wristband having 1. a hook and loop means for adjustably securing said wristband about said wrist joint;
2. a flexible support member projecting from said wristband and having sufficient stiffness for placement, specific positioning and providing support against a part of the back portion of said hand during use of said device, the support member projecting in a position extending from over the area of said brachioradialis muscle at said muscle over said radius bone at said wrist, over said transverse carpal ligament and along and over the second metacarpal, terminating substantially at the first knuckle of the index finger;
3. said flexible support member includes a top surface and attached thereto a hook means and a bottom surface having attached thereto a loop means; and B. a glove adapted to be attached to said wrist and hand support device, said glove having 1. a back portion that contacts the surface of the back of the user's hand;
2. a flap means attached to said glove for adjustably securing said glove about said hand;
3. a hook means on said back portion surface for securing said bottom surface's loop means of said flexible support member; and
4. a loop means on the bottom surface of said flap means for securing said top surface's hook means of said flexible support member;

whereby said flexible support member is interposed and affixed between said top surface of said glove and said bottom surface of said flap.

* * * * *